US005343786A

United States Patent [19]

Wridt

[11] Patent Number: 5,343,786

[45] Date of Patent: Sep. 6, 1994

[54] BIT AND SOCKET COMBINATION

[75] Inventor: Gerald A. Wridt, Racine Gaw, Wis.

[73] Assignee: Snap-on Incorporated, Kenosha, Wis.

[21] Appl. No.: 36,321

[22] Filed: Mar. 24, 1993

[51] Int. Cl.[5] ..... B25B 23/00

[52] U.S. Cl. ..... 81/438; 81/439; 279/9.1

[58] Field of Search ..... 81/437, 438, 439, 121.1; 279/9.1, 89, 95

[56] References Cited

U.S. PATENT DOCUMENTS

| | | | |
|---|---|---|---|
| 2,288,584 | 6/1942 | Longfellow | 81/438 |
| 2,457,451 | 12/1948 | Domack . | |
| 2,519,559 | 8/1950 | Foster et al. | 81/439 X |
| 2,735,325 | 2/1956 | Rudd, Sr. | 81/439 |
| 2,878,701 | 3/1959 | Weersma . | |
| 3,177,910 | 4/1965 | Da Silva | 81/437 X |
| 4,982,632 | 1/1991 | Barmore . | |

FOREIGN PATENT DOCUMENTS

| | | | |
|---|---|---|---|
| 0491153 | 6/1992 | European Pat. Off. | 279/9.1 |

OTHER PUBLICATIONS

Snap-on Tools 1992 Catalog, p. 179, illustrating Ratchet and Bit Set.

*Primary Examiner*—D. S. Meislin
*Attorney, Agent, or Firm*—Emrich & Dithmar

[57] ABSTRACT

A tool combination includes a bit socket with a hole extending axially therethrough and having a square drive portion and a hexagonal portion and a circularly cylindrical retaining portion between said drive portion and said bit portion, the portions being of successively smaller width from the drive end to the bit end. A hexagonal bit has an application end and a coupling end, the application end being insertable into the hole from the drive end thereof. The coupling end is provided with a retainer in the form of either an enlarged head or a laterally projecting ear which seats in the retaining portion of the hole, with the application end of the bit projecting forwardly from the bit end of the socket. An associated drive lug, when received in the drive portion of the hole, retains the bit place.

7 Claims, 1 Drawing Sheet

BIT AND SOCKET COMBINATION

BACKGROUND OF THE INVENTION

1. Field of the Invention

The present invention relates to socket wrench sets and, in particular, to a socket adapted to receive any of a plurality of different-sized bits.

2. Description of the Prior Art

It is known to provide socket wrench sets wherein at least one of the sockets is a bit socket, i.e., a socket which is adapted to receive any of a number of different-sized bits. Such bits may be of any of a number of different types, such as screwdriver bits, wrench bits and other types of drive configurations. Typically, each such bit has a polygonal shank provided at an application end with a drive configuration adapted for a particular drive application. The shank is dimensioned to fit into the workpiece-engaging end of a wrenching socket, being retained in place therein by a set screw or roll pin or the like, received through radial bores in the socket, or by a friction ring, such as a wire ring or O-ring. For example, the socket may have a hexagonal workpiece engaging end, in which case each of the bits will have a hexagonal shaft mateably engageable in the socket. The socket also has a drive recess at a drive end thereof, which may be a square recess adapted to receive a drive lug of an associated driving tool, such as a ratchet wrench or the like. In this way, a single socket may be used with a driving tool to drive a plurality of different bits.

However, in this prior arrangement, in the event a set screw or roll pin is used for bit retention, engagement and disengagement of the bits in the socket is relatively cumbersome and time consuming, requiring the mounting and demounting of the set screw or roll pin, each time the bit is changed. Indeed, it is so cumbersome that normally a user will purchase a separate socket for each bit to obviate bit changing. Furthermore, the set screw or roll pin constitutes an additional part which must be manufactured, inventoried, and kept track of, which adds to the cost of manufacture and assembly, and further entails the risk of loss by the user. The use of a friction ring for bit retention simplifies bit changing but does not provide a very secure retention.

It is also known to provide a bit set for use with a box ratchet wrench, each of the bits having a shank which is insertable into the box ratchet, and the depth of insertion being limited by a lateral projection on the bit shank approximately midway along its length. Such ratchet and bit sets are sold, for example, by Snap-on Tools Corporation under the designation CRA180PB. Typically, the box ratchet is provided with an O-ring or the like to frictionally hold the bit in place in the ratchet.

SUMMARY OF THE INVENTION

It is a general object of the invention to provide an improved torque-applying bit and socket combination which avoids the disadvantages of prior such combinations while affording additional structural and operating advantages.

An important feature of the invention is the provision of a bit and socket combination of the type set forth, wherein the bit is retained in the socket without the use of additional parts.

Still another feature of the invention is the provision of an improved bit and socket combination of the type set forth, wherein the bit is inserted into the socket from the drive end thereof.

In connection with the foregoing feature, another feature of the invention is the provision of a bit and socket combination of the type set forth, wherein the socket is retained in place by an associated drive lug.

Yet another feature of the invention is the provision of a socket for use in a bit and socket combination of the type set forth.

Yet another feature of the invention is the provision of a bit for use in a bit and socket combination of the type set forth.

These and other features of the invention are attained by providing a tool combination for transmitting torque from a drive lug of a driver to a workpiece, comprising: a socket member having a drive end and a bit end and a longitudinal hole therethrough from end to end, the hole having a drive portion adjacent to the drive end for receiving the drive lug in driven engagement therewith and a bit portion adjacent to the bit end and a retaining portion between the drive portion and the bit portion, a shoulder in the hole between the retaining portion and the bit portion facing the drive end, and an elongated bit having an application end engageable with the workpiece and a coupling end and laterally extending projection means adjacent to the coupling end, the application end of the bit being insertable in the hole from the drive end thereof with the projection means being engageable with the shoulder to limit the depth of insertion at a working position wherein the application end of the bit projects outwardly beyond the bit end of the socket member, the shoulder cooperating with the drive lug when received in the drive portion for engagement with the coupling end of the bit when disposed in the working position to retain the bit in the hole.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

DESCRIPTION OF THE PREFERRED EMBODIMENTS

Figure 1:
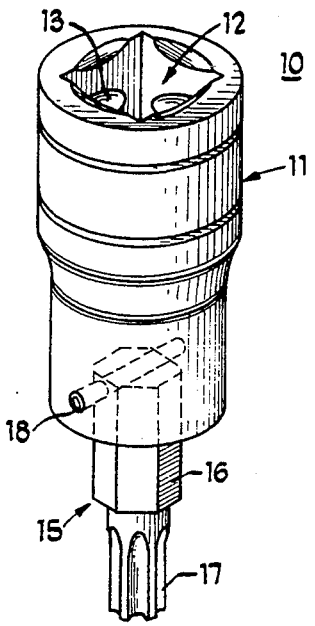
Fig 1 PRIOR ART
FIG. 1 is a perspective view of a prior art bit and socket combination.

Referring to FIG. 1, there is illustrated a prior tool combination or assembly 10 comprising a socket 11 and a bit 15. The socket 11 has a drive recess 12 which may be substantially square in transverse cross section for receiving a drive lug of an associated driving tool (not shown), such as a ratchet wrench. The drive recess 12 may be provided with detent recesses 13 for receiving a detent ball of the associated drive lug to retain the socket 11 in place on the driving tool in a known manner. The socket 11 is provided at its other end with a workpiece-engaging recess (not shown), which is typically polygonal in transverse cross section and is adapted to receive a correspondingly shaped bit in a known manner.

The bit 15 has a shank 16 which is shaped for mating engagement in the workpiece-engaging recess of the socket 11, both the shank and the recess being hexagonal in shape in the illustrated embodiment. The bit 15 is provided at its distal end with an application tip 17 shaped and dimensioned for a particular application. For example, the application tip 17 may be a screwdriver bit, a hexagonal key, or any of a number of other types of male drive configurations adapted to be received in complementary female recesses in members to be driven. A roll pin 18 extends diametrically through complementary aligned bores in the socket 11 and the bit shank 16, to fixedly secure the bit 15 in the socket 11. Alternatively, a set screw could be used.

It will be appreciated that any of a number of different bits may be thus mounted in the socket 11, each of these bits having the same size and shape shank 16, but having different sized and/or shaped application tips 17, so that a single socket can be used to drive a number of different bits. The socket 11 is similar to a standard configuration except for the presence of a diametrical bore in a thickened sidewall to accommodate the roll pin 18 or set screw. However, the use of the roll pin or set screw to mount and demount the bit 15 is a major inconvenience, to the point that users typically purchase a separate socket for each bit to obviate bit changing. It represents an extra part with all the attendant disadvantages in manufacturing, inventorying, storage and use. Furthermore, the roll pin or set screw 18 may work free in use or the roll pin may break, allowing the bit 15 to fall out of the socket 11. A friction ring (not shown) may be used in lieu of the roll pin or set screw 18 to retain the bit 15 in the socket 11. This simplifies bit interchange but does not provide a very secure retention of the bit.

Figure 5:
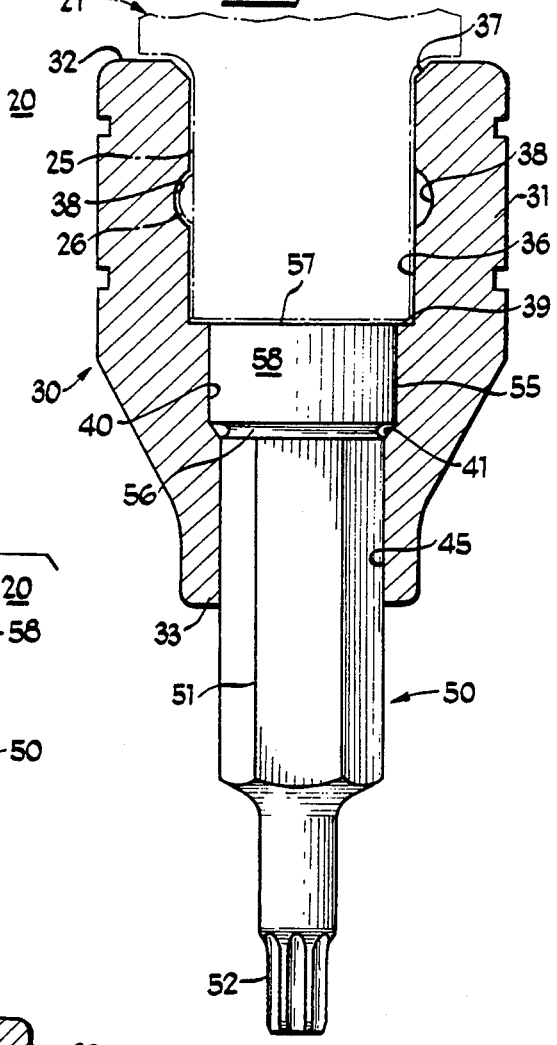
FIG. 5 is an enlarged view in vertical section of the socket of FIG. 4 with the bit of FIG. 4 engaged therein and illustrated in side elevation, and with an associated drive lug illustrated in phantom.

Referring to FIG. 5, there is illustrated a tool combination or assembly 20 constructed in accordance with and embodying the features of the present invention, and including a socket 30 and a bit 50. The socket 30 is adapted for use with an associated driving tool 21 having a drive lug 25 provided with a detent ball 26, in the same manner as was described above in connection with the socket 11.

Figure 2:
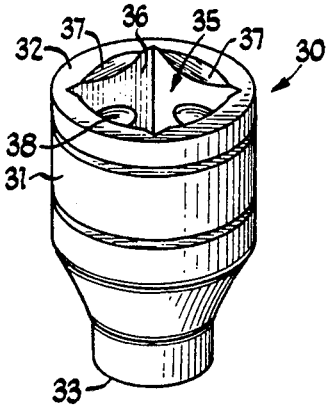
FIG. 2 is a perspective view of a socket constructed in accordance with and embodying the features of the present invention.
Figure 3:
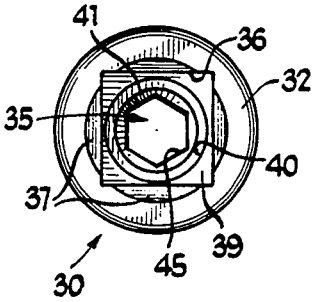
FIG. 3 is a top plan view of the socket of FIG. 2.
Figure 4:
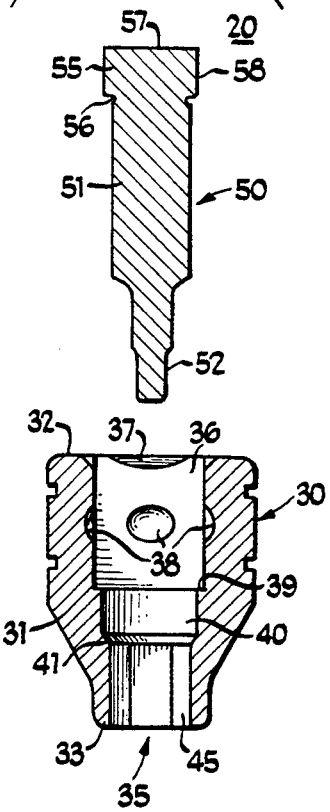
FIG. 4 is an exploded view in vertical section of the socket of FIG. 2 and an associated bit in accordance with the present invention.

Referring also to FIGS. 2–4, the socket 30 includes a generally cylindrical body 31 having a drive end 32 and a bit end 33. The socket body 31 has a hole 35 extending axially therethrough from the drive end 32 to the bit end 33 thereof. The hole 35 includes a drive portion 36 which extends axially inwardly from the drive end 32 and is substantially square in transverse cross section for receiving the square drive lug 25 of the associated driving tool 21. The driving portion 36 may be provided with beveled or tapered guide surfaces 37 at the entry end thereof to facilitate insertion of the drive lug 25, and may also be provided with detent recesses 38 for receiving the detent ball 26 of the drive lug 25 to retain the socket 30 on the drive lug 25, all in a known manner.

The drive portion 36 communicates at its inner end with a circularly cylindrical retaining portion 40 having a diameter less than the width of the drive portion 36, so that the bottom wall of the drive portion 36 defines a shoulder 39 which surrounds the retaining portion 40 and faces the drive end 32 of the socket 30. The other end of the retaining portion 40 is joined by a frustoconical shoulder 41 to a hexagonal bit portion 45, which extends to the bit end 33 of the socket 30. The bit portion 45 has a width which is less than the diameter of the retaining portion 40, so that the shoulder 41 converges toward the bit end 33 and faces the drive end 32 of the socket 30. While the bit portion 45 is illustrated as having a hexagonal shape, it will be appreciated that it could have other polygonal shapes.

Figure 6:
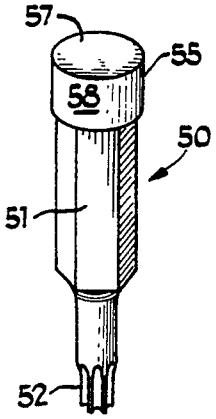
FIG. 6 is a perspective view of the bit of FIG. 4.

Referring in particular to FIGS. 4, 5 and 6, the bit 50, has an elongated shank 51, hexagonal in transverse cross section and dimensioned to be mateably received in the bit portion 45 of the socket hole 35 for driven engagement thereby, in a known manner. The shank 51 is provided at one end thereof with an application tip 52 which has a transverse width less than or equal to that of the shank 51 so as to be freely receivable through the bit portion 45 of the socket hole 35, and is provided at least at its distal end with a desired application configuration. In the illustrated embodiment, the application tip 52 has a fluted configuration, but it will be appreciated that any desired configuration, such as a screwdriver blade of any desired configuration, a hexagonal key, or the like may be used. The shank 51 is provided at its other end with an enlarged, circularly cylindrical head 55, which is joined to the shank 51 by a circumferential undercut or groove 56 which is generally part-circular in transverse cross section. The head 55 has a circular end surface 57 and a circularly cylindrical side surface 58 which has a diameter slightly greater than the width of the shank 51 and is dimensioned to be mateably received in the retaining portion 40 of the socket hole 35.

In operation, the bit 50 is dropped into the socket hole 35 from the drive end 32 of the socket 30. More specifically, the application tip 52 of the bit 50 is inserted into the drive portion 36 of the socket hole 35 and allowed to drop therethrough until it reaches a use position illustrated in FIG. 5, wherein the bit head 55 seats against the shoulder 41, with the shank 51 extending through the bit portion 45 and beyond the bit end 33 of the socket 30. Preferably, the head 55 of the bit 50 is so dimensioned that the end surface 57 thereof is substantially coplanar with the shoulder 39 when the head 55 is seated on the shoulder 41. It will be appreciated that when the drive lug 25 of the driving tool 21 is inserted in the drive portion 36 of the socket hole 35, it retains the bit 50 in place in the hole 35 and cooperates with the shoulder 41 substantially to inhibit axial movement of the bit 50. Thus, separate retaining members, such as roll pins or set screws are obviated.

Figure 7:
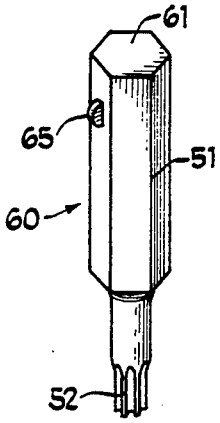
FIG. 7 is a view similar to FIG. 6 of a bit in accordance with another embodiment of the invention.

Referring to FIG. 7, there is illustrated an alternative form of bit 60, which is substantially similar to the bit 50, with like parts bearing the same reference numerals. However, the bit 60 is not provided with an enlarged head. Rather, the shank 51 has a hexagonal end surface 61 and is provided with one or more laterally outwardly projecting ears 65 (one shown) spaced axially from the end surface 61 a distance substantially equal to the axial extent of the retaining portion 40 of the socket hole 35. While one ear 65 is illustrated, preferably two are provided at diametrically opposed locations on the shank 51. Thus, it will be appreciated that the bit 60 is inserted in the socket hole 35 in the same manner as was described above with respect to the bit 50, until the ears 65 seat against the shoulder 41. It will be appreciated that the positioning of the ears 65 is such that, when thus seated, the end surface 61 of the bit 60 is substantially coplanar with the shoulder 39 of the socket hole 35.

Preferably, the bit shank 51 has a length such that, when the bit 50 or 60 is seated in its use position in the socket 30, the shank 51 projects well beyond the bit end 33 of the socket 30. In any event, the retaining portion of the bit 50 or 60, i.e., the inner end of the head 55 or the ears 65, are spaced from the adjacent end surface 57 or 61 of the bit 50 or 60 a distance substantially less than the distance they are spaced from the opposite end of the shank 51. Preferably, the latter distance is three to six times the former.

From the foregoing, it can be seen that there has been provided an improved socket and bit tool combination which is of simple and economical construction and characterized by ease of use with a minimum number of parts.

I claim:

1. A tool combination for transmitting torque from a drive lug of a driver to a workpiece, comprising: a unitary one-piece socket member having a drive end and a bit end and a longitudinal hole therethrough from end to end, said hole having an open drive portion adjacent to said drive end for receiving the drive lug in driven engagement therewith and a bit portion adjacent to said bit end and a retaining portion between said drive portion and said bit portion, a first shoulder in said hole between said retaining portion and said bit portion facing said drive end, a second shoulder in said hole between said retaining portion and said drive portion facing said drive end and disposed for engagement with the drive lug when it is received in said drive portion, and an elongated bit having an application end engageable with the workpiece and a coupling end and laterally extending projection means adjacent to said coupling end, said application end of said bit being insertable in and removable from said hole from said drive end thereof with said projection means being engageable with said first shoulder to limit the depth of insertion at a working position wherein said application end of said bit projects outwardly beyond said bit end of said socket member, said coupling end having an end surface substantially coplanar with said second shoulder when said projection means is disposed in engagement with said first shoulder.

2. The tool combination of claim 1, wherein said first shoulder is substantially frustoconical in shape.

3. The tool combination of claim 1, wherein said bit includes an elongated shank extending between said application and coupling ends, said projection comprising an enlarged head at said coupling end and projecting laterally beyond said shank around the entire circumference thereof.

4. The tool combination of claim 1, wherein said projection means includes at least one laterally-extending ear.

5. The tool combination of claim 1, wherein said drive portion of said hole is substantially square in transverse cross section.

6. The tool combination of claim 1, wherein said retaining portion is circularly cylindrical in transverse cross section.

7. The tool combination of claim 1, wherein said bit portion of said hole is polygonal in transverse cross section.

* * * * *